United States Patent [19]

Kay

[11] 4,212,564

[45] Jul. 15, 1980

[54] DOCK

[76] Inventor: Charles Kay, 9390 Whitneyville Ave., Alto, Mich. 49302

[21] Appl. No.: 955,121

[22] Filed: Oct. 26, 1978

[51] Int. Cl.[2] ..... E02B 3/20

[52] U.S. Cl. ..... 405/218; 114/263; 52/828

[58] Field of Search ..... 405/218, 219, 220, 221; 52/821, 828; 114/263

[56] References Cited

U.S. PATENT DOCUMENTS

| | | | |
|---|---|---|---|
| 1,343,168 | 6/1920 | Young | 52/828 X |
| 2,571,337 | 10/1951 | Burnham | 405/218 |
| 2,652,694 | 9/1953 | Melges | 405/221 |
| 2,666,233 | 1/1954 | Klemm | 52/828 X |
| 2,948,121 | 8/1960 | Karst | 405/220 |
| 3,073,274 | 1/1963 | Lamb | 405/219 X |
| 3,287,919 | 11/1966 | Hahn | 405/218 |
| 3,371,902 | 3/1968 | Hartwick | 52/157 |
| 3,824,796 | 7/1974 | Nasby | 405/220 |

*Primary Examiner*—Dennis L. Taylor

*Attorney, Agent, or Firm*—Price, Heneveld, Huizenga & Cooper

[57] ABSTRACT

A lightweight dock structure, the deck of which is supported on deck-straddling columns, and which comprises an upper compression layer and a vertically spaced lower tension layer, each layer formed of a plurality of transverse elements, said elements in each layer and said layers being interconnected by horizontally elongated flanged stringer plates extending between said layers normal to said elements, with the flanges of the stringer plates embedded in said elements in both layers.

3 Claims, 7 Drawing Figures

DOCK

BACKGROUND OF THE INVENTION

This invention relates to a dock structure.

Docks typically constitute structures formed of a supporting under-framework of interconnected girders and posts onto which boards are nailed, screwed, or similarly fastened.

Typically the structure is fabricated in place and constitutes a heavy construction permanently anchored into the beach. Such constructions require considerable expense and labor to build. And, unfortunately, in bodies of water which freeze during winter months, the ice which breaks up in the spring tends to crush the dock or wrench it loose and transport it elsewhere. Such docks also present difficulty with water level changes since lowering water levels can leave the dock on dry land and raising water levels can leave the dock spaced from the shore and even under water.

An alternate dock structure is the floating type. However, such units create a feeling of instability when walked upon, and further, can be moved about by rough water.

Prior dock components are typically held together by nails, screws, or equivalent fasteners. Such fasteners tend to work loose and project to become safety hazards, particularly for persons with bare feet.

SUMMARY OF THE INVENTION

A lightweight dock structure having a deck in modular components for ready on-site installation and anchoring to the beach with special cooperative supports. The elongated deck modules are supported on spaced, transverse, anchoring and supporting mounts having anchor posts capable of ready insertion into and removal from the beach for ready installation and ready removal for wintering. The deck modules each comprise an upper compression layer and a vertically spaced lower tension layer, each layer formed of a plurality of transverse elements, said elements in each layer and also said layers being interconnected by elongated flanged stringer plates vertically between said layers with their flanges embedded in said elements, and extending horizontally normal to said elements. No nails, screws, or other like fasteners are required to be potentially exposed as safety hazards.

DESCRIPTION OF THE PREFERRED EMBODIMENT

The dock 10 is shown to include a plurality of dock modules arranged in two sections 12 and 12' perpendicular to each other in T-type arrangement for illustrative purposes. These can be arranged in a variety of orientations relative to each other to form a dock of a desired configuration. For convenience, the details of one such module will be described.

Figure 2:
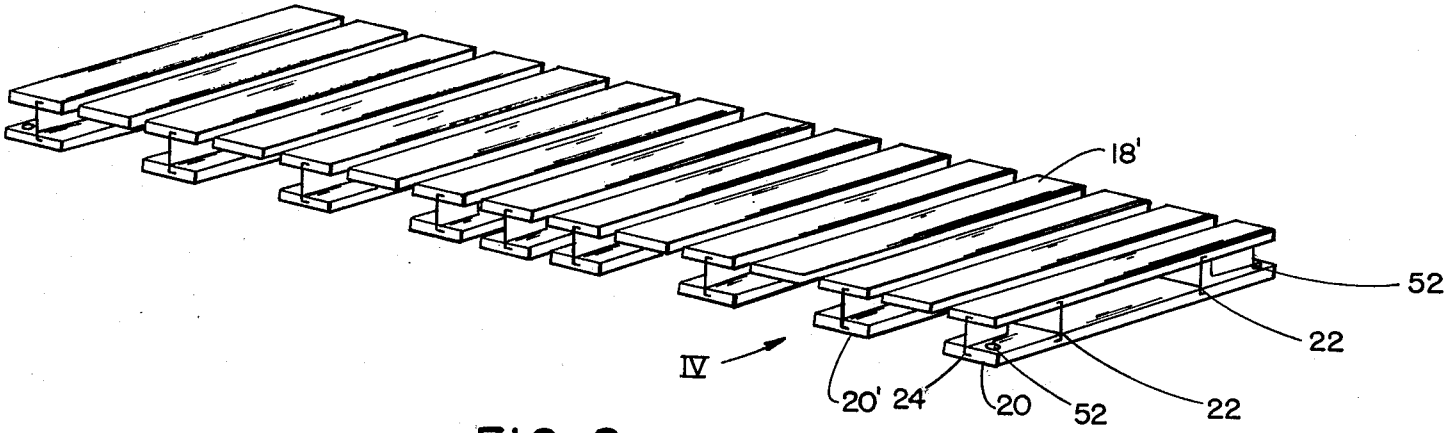
FIG. 2 is an enlarged perspective view of a portion of the dock in FIG. 1.
Figure 1:
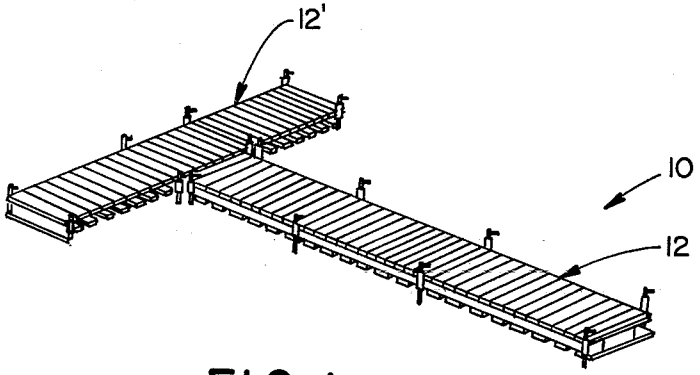
FIG. 1 is a perspective view of a dock employing this invention.

Each dock module comprises a deck subassembly 14 and at least two supporting anchoring mount subassemblies 16. The deck has an upper compression layer 18 and a lower tension layer 20 spaced from the upper layer, these being interconnected and secured in relation to each other by horizontally elongated sheet metal stringer plates 22 which are flanged on the vertical edges thereof. In the depicted embodiment, two such stringers are shown. The flanges and adjacent portions of the stringer plates are embedded into the elements forming the upper and lower platforms. These elements preferably are of wood, with the stringer plates being forcefully embedded therein as by use of the equipment set forth in U.S. Pat. No. 3,714,696. The upper layer of the deck is composed of a plurality of closely spaced transverse elements 18' (FIG. 2), while the lower layer is formed of a plurality of optionally more widely spaced transverse elements 20. Preferably, a plurality of short reinforcing stringer plates 24 extending parallel to elements 18' and 20' interconnect the ends of elements 18' and 20' that are vertically aligned, to restrain the boards against warpage and generally reinforce the structure. These are at both end portions of the elements outwardly of and astraddle the elongated stringers 22.

Supporting the deck modules are mounts 16 at spaced intervals along the deck. Each mount is H-shaped, comprising a pair of vertical parallel housing sleeves 30 and 30' rigidly interconnected by a transverse under-deck crosspiece or beam 32 and slidably receiving a pair of vertical pillars 34 and 34'. These pillars have cylindrical posts with crank handles 36 and 36' at the upper ends thereof. The posts fit into cylindrical openings in the sleeves, to be vertically slidable and rotational relative to sleeves 30 and 30'. At the lower ends of the posts are helical blades 38 and 38', respectively, to cause the posts to dig into and be embedded in the beach beneath the water when rotated by handles 36 and 36'. The degree of embedment of the individual posts into the beach is limited by annular plates 40 and 40' affixed on the posts above the helical blades 38 and 38' and below the sleeves 30 and 30'. Retaining elements such as set screws or bolts 42 and 42' are threaded through sleeves 30 and 30' to interengage the posts 34 and 34' for retaining the sleeves at a particular vertical spacing above the lower end of the posts and above the water level. Alternatively, pins can be inserted through the sleeves and post.

Secured to the exterior of the sleeves 30 and 30' are a pair of inwardly facing L-shaped support brackets 46 and 46', the vertical legs of which are secured to the sleeves, and the horizontal legs of which extend toward each other for supporting the deck thereon. The ends of lower elements 20' of deck module layer 20 rest thereon.

Figure 6:
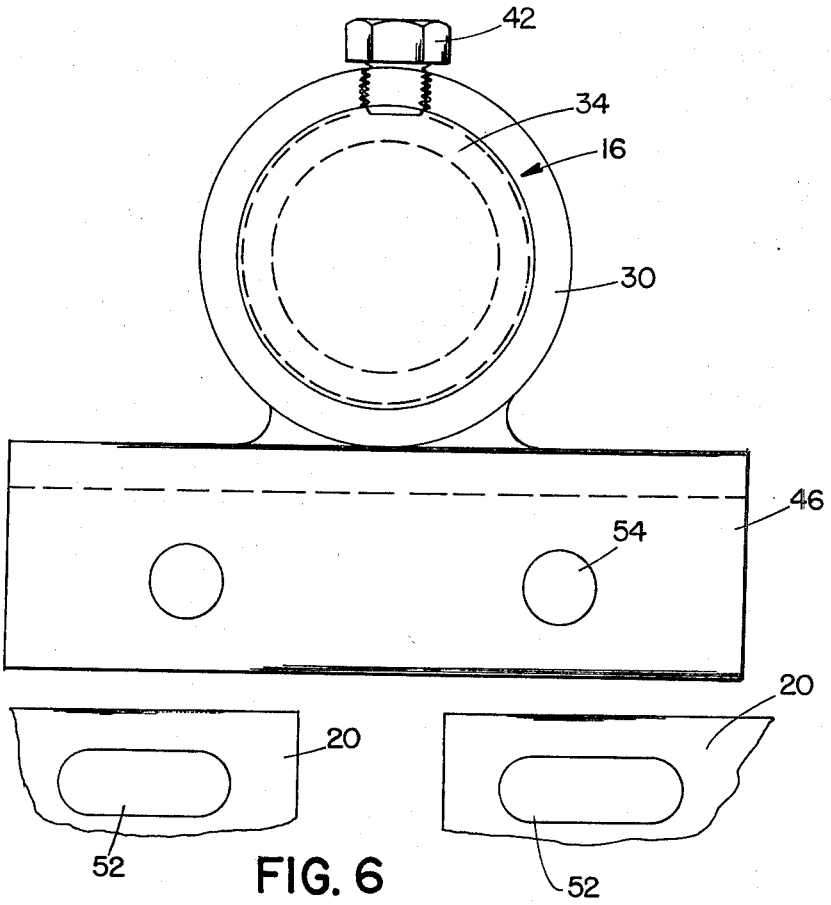
FIG. 6 is an enlarged plan view of a portion of one of the mounts.
Figure 3:
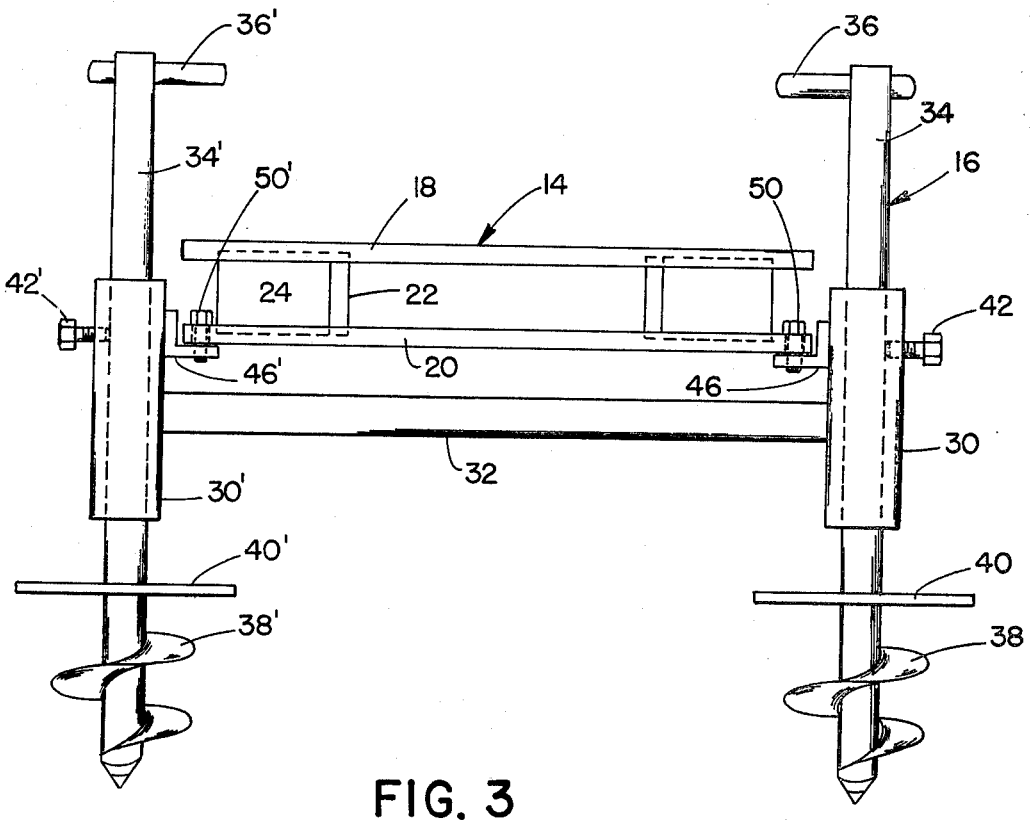
FIG. 3 is an end elevational view of a portion of the dock in FIG. 1.

One of the double pillar units 16 is located at the abutting ends of each two deck modules as well as at other selected locations along the deck for the support needed. The deck modules are anchored to brackets 46 and 46' by pins or fasteners such as bolts 50 and 50' which extend through a pair of holes 52 (FIG. 2) (FIG. 6) on the ends of the lower elements 20' of each module and through cooperative holes in brackets 46 and 46', e.g. holes 54 in bracket 46 (FIG. 6).

In use, the assembly can be readily installed by turning the anchor and support posts into the beach at spaced intervals, locking the posts to the sleeves by anchor elements, e.g. 42, positioning prefabricated deck modules in abutment with each other and supported on brackets 46 and 46', and fastening the modules to the brackets of the double pillar mount units. To remove the dock for cold weather, the deck modules are released from the double pillar units and removed, the pillar posts are unfastened from the sleeves, and the posts are turned out of the earth of the beach and removed.

Figure 7:
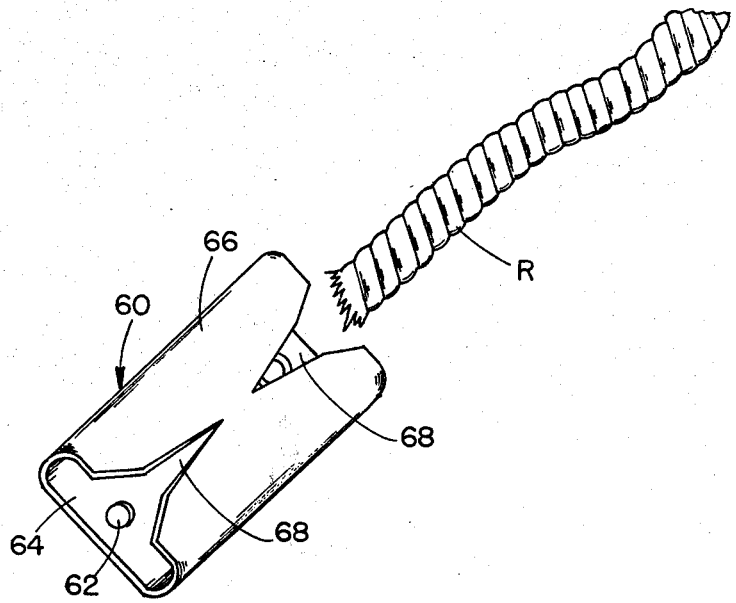
FIG. 7 is a perspective view of a mooring clip for attachment to the dock.
Figure 5:
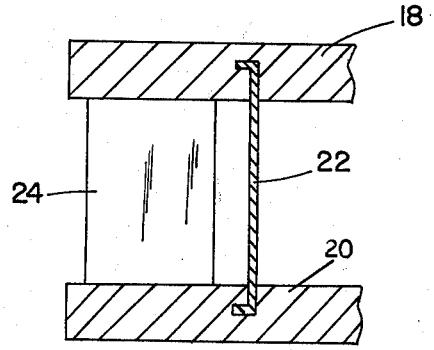
FIG. 5 is an enlarged fragmentary elevational view of a portion of the apparatus in FIG. 4 viewed in the direction V.
Figure 4:
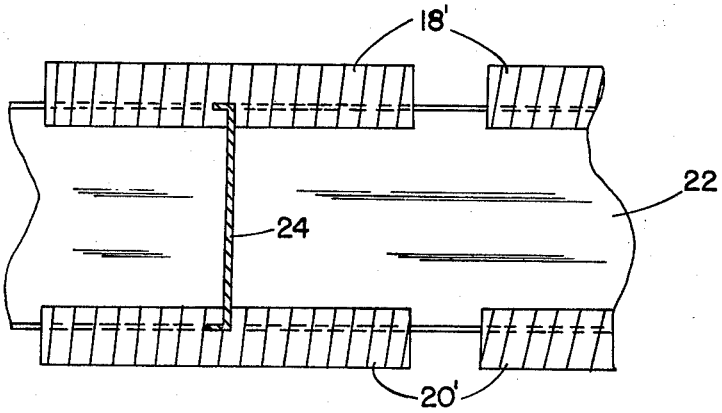
FIG. 4 is an enlarged sectional elevational fragmentary view of the structure in FIG. 2, viewed from the direction IV.

To enable a boat, raft, or the like to be moored at the dock, a plurality of clips 60 (FIG. 7) can be attached either to the pillars or the deck structure. The cross section of each of these clips is basically generally ovular or eliptical, having a rear mounting face 64 containing openings 62 for fasteners, and a spaced front face 66 having a pair of V-shaped slots 68 extending from the opposite ends toward each other so that a rope R placed through the tubular element and pulled laterally into one of the slots will bind and anchor the rope and boat.

The embodiments of the invention in which an exclusive property or privilege is claimed are defined as follows.

1. A dock structure comprising:

spaced, H-shaped anchoring and support mounts, and elongated deck modules supported thereon; each of said mounts including deck support structure and a pair of vertical anchor posts rotational relative to said support structure and having a helical blade to cause said posts to be earth-embedded when rotated; the vertical legs of the H including said posts and including post-receiving and deck-supporting sleeves, and the cross leg of the H interconnects said sleeves; and means for fastening said deck modules to said support structure of said mounts, said deck modules each having an upper compression layer and a lower tension layer spaced therebeneath, flanged stringer plates interconnecting said layers with the flanges thereof embedded in said layers; and said layers having a plurality of transversely extending elements and said stringers being normal thereto.

2. A dock structure formed of an elongated deck and two or more spaced upright H-shaped mounts; said deck having an upper layer and a spaced lower layer, said layers being interconnected by elongated stringer plates having upper and lower flanged ends embedded in the respective ones of said upper and lower layers; said mounts each including a pair of upright anchoring and support pillars at opposite sides of said deck and a transverse element rigidly interconnecting said pillars; said lower layer being supported on said pillars for support of said deck.

3. The dock structure in claim 2 wherein said pillars include rotational posts with helical blades thereon for embedment in the earth of a beach by rotation of said posts.

* * * * *

UNITED STATES PATENT AND TRADEMARK OFFICE

CERTIFICATE OF CORRECTION

PATENT NO. : 4,212,564

DATED : July 15, 1980

INVENTOR(S) : Charles Kay

It is certified that error appears in the above-identified patent and that said Letters Patent are hereby corrected as shown below:

Column 4, line 21:

Claim 2, line 5:

"flanged ends" should be ---flanged edges---

Signed and Sealed this

Eleventh Day of November 1980

[SEAL]

Attest:

SIDNEY A. DIAMOND

Attesting Officer

Commissioner of Patents and Trademarks